United States Patent [19]

Meyrowitsch

[11] Patent Number: 4,962,602

[45] Date of Patent: Oct. 16, 1990

[54] STICKER FOR ALARM SYSTEM

[76] Inventor: Ralph S. Meyrowitsch, Birkehaven 112, DK-2980 Kokkedal, Denmark

[21] Appl. No.: 204,700

[22] PCT Filed: Oct. 5, 1987

[86] PCT No.: PCT/DK87/00120

§ 371 Date: Jun. 3, 1988

§ 102(e) Date: Jun. 3, 1988

[87] PCT Pub. No.: WO88/02525

PCT Pub. Date: Apr. 7, 1988

[30] Foreign Application Priority Data

Oct. 3, 1986 [DK] Denmark ..... 4733/86

[51] Int. Cl.[5] ..... G09F 13/00

[52] U.S. Cl. ..... 40/541; 40/638; 40/591

[58] Field of Search ..... 40/541, 553, 442, 1.5, 40/1.6, 299, 544, 594, 638, 902, 591, 593; 340/691; 362/31, 800, 100, 189

[56] References Cited

U.S. PATENT DOCUMENTS

| | | | |
|---|---|---|---|
| 2,975,538 | 3/1961 | Murfin | 40/299 |
| 3,038,271 | 6/1962 | MacHutchin et al. | 40/542 |
| 4,059,912 | 11/1977 | Noah | 40/299 |
| 4,270,291 | 6/1981 | Babberl | 40/594 |
| 4,420,898 | 12/1987 | Moses . | |
| 4,709,307 | 11/1987 | Branom | 362/806 |

FOREIGN PATENT DOCUMENTS

| | | | |
|---|---|---|---|
| 0202067 | 11/1986 | European Pat. Off. . | |
| 2806803 | 10/1979 | Fed. Rep. of Germany . | |
| 3435385 | 4/1986 | Fed. Rep. of Germany . | |
| 2027249 | 2/1980 | United Kingdom | 40/1.5 |
| 2185842 | 7/1987 | United Kingdom | 40/1.5 |

OTHER PUBLICATIONS

Secar 2000 Billarm, 3 pp., Article, Feb 1985.

*Primary Examiner*—Cary E. Stone
*Attorney, Agent, or Firm*—Ladas & Parry

[57] ABSTRACT

A label for an alarm system having a light emitting diode and an integrated electronic circuit, causing the diode to flash, sandwiched between at least two sheets of material. The flashing diode makes the alarm warning highly conspicuous, particularly in dim day light sand darkness.

6 Claims, 2 Drawing Sheets

STICKER FOR ALARM SYSTEM

Self-adhesive labels e.g. with printed warning—ALARM—are known and extensively used in connection with burglar alarms. The text on the labels may vary, but their purpose is the same, viz. preventive warning that house/car/firm are secured with a burglar alarm system.

Particularly in case of car alarms a great preventive effect has been observed when such a label has been adhered on the inside of the car window.

In some systems of car burglar alarms, the instrument panel or the window of the car may have adhered to it a small plastics box, which accommodates a flashing control lamp. The purpose is partly to control that the alarm is connected, partly to warn that the burglar alarm is active.

The invention concerns a label for alarm systems, and its object is to provide such a label whose warning effect is enhanced by simple and inexpensive means.

This object is achieved in that the label is constructed as stated in claim 1, since the light source will call attention directly to the label, particularly, of course, when it is dark or dim.

When a flashing label is to be adhered to e.g. a glass pane, the protective paper is removed from the adhesive front side of the label, as is the case with other self-adhesive labels. After adhesion and connection to the burglar alarm system or other power source, the label will flash and thus warn that the burglar alarm has been connected.

The flashes of the light diode, e.g. one flash per second, provide, as mentioned, an enhanced preventive effect of the function of the warning label. This applies in particular in dim day light or darkness where it may be difficult to see a normal warning label.

Figure 1:
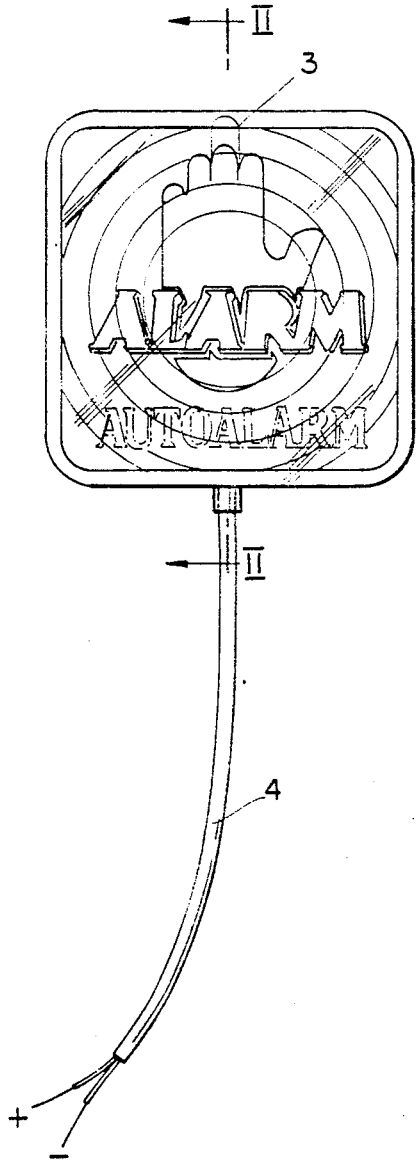
Figure 3:
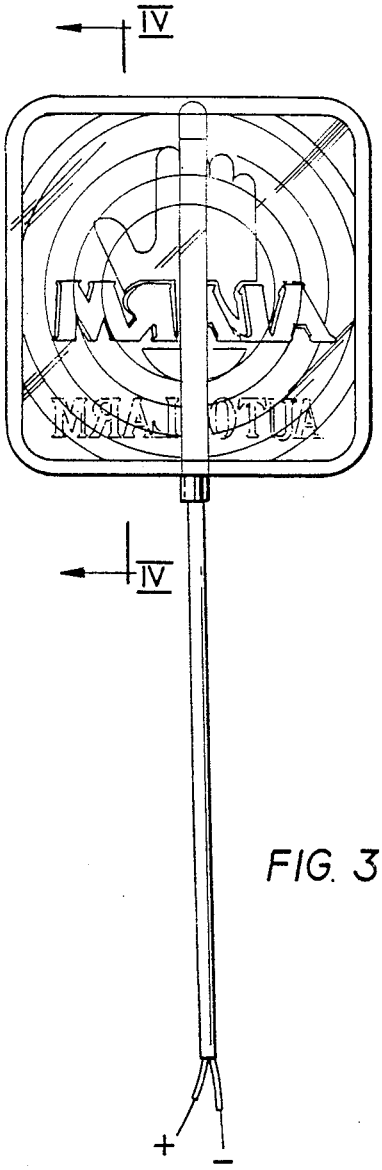
Figure 4:
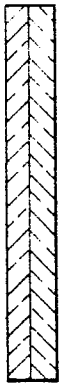

Owing to the simple structure, the invention makes it possible to produce a flashing warning label which improves the preventive effect of the warning label for a burglar alarm system in a simple and inexpensive manner. The mounting of the flashing light diode with its auxiliary circuits is an extremely simple process. An embodiment of a warning label of the invention is shown in the drawing, in which FIG. 1 is a front view of the label, FIG. 2 is a section along the line A—A in FIG. 1, FIG. 3 is a rear view of the label, and FIG. 4 is a section along the line B—B in FIG. 3.

Figure 2:
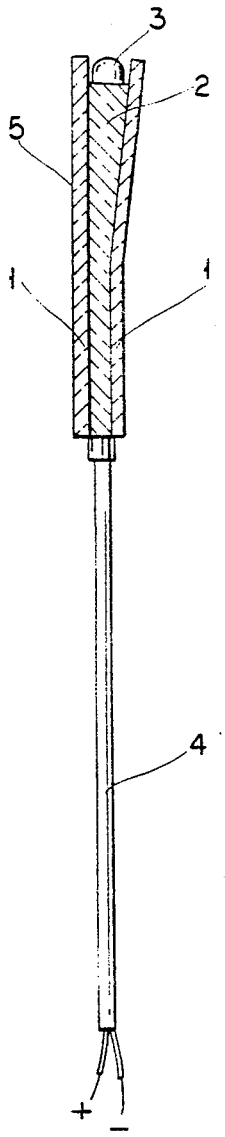

The flashing label may consist of two layers of fusible sheets 1, FIG. 2, between which a small electronic circuit 2 and a flashing light diode 3 is embedded or sandwiched. The warning text 5 is printed or glued as a double-adhesive sheet on the front or rear side of the label. A lead 4 is connected to the burglar alarm or an external power source.

In the embodiment shown, one light diode or lamp is fitted; but nothing prevents the use of several flashing light diodes or lamps.

The shown and described structure may be modified in several ways within the scope of the invention. The light source might e.g. be placed on the rear side on a transparent label instead of being sandwiched between two adhered layers. It may also be adapted to edge-illuminate a label so that a pattern or text embossed in the label appears as luminous portions. Nor is the use of the invention conditional upon the label being transparent or transluscent. Another possibility is to provide the label with strips, e.g. in the form of a pattern or a text, of a material which may be caused to be fluorescent.

I claim:

1. A label connectable to an alarm system comprising:

a first sheet, having a means for mounting said first sheet on a light transmitting surface so that a warning sign on said label is visible through said surface; and a second sheet fixed to said first sheet so that at least one light emitting diode is positioned between said first and second sheets to project the light from the diode through said light transmitting surface and illuminate said label.

2. A label according to claim 1, wherein said diode is connected to an integrated circuit which causes said light emitting diode to flash.

3. A label according to claim 2, wherein said integrated circuit is positioned between said first and second sheets.

4. A label according to claim 3, wherein the first sheet is transparent.

5. A label according to claim 3, wherein the first sheet is translucent.

6. A label connectable to an alarm system comprising:

at least one sheet, having a means for mounting said first sheet on a light transmitting surface so that a warning sign on said label is visible through said surface; and a light emitting diode attached to said sheet to project the light from said diode through said light transmitting surface and illuminate said label.

* * * * *